US006072438A

United States Patent [19]

McKay et al.

[11] Patent Number: 6,072,438

[45] Date of Patent: Jun. 6, 2000

[54] FULL DYNAMIC RANGE REFLECTARRAY ELEMENT

[75] Inventors: James P. McKay, Manhattan Beach; Michael E. Cooley, Newbury Park; Michael E. Pekar, Redondo Beach, all of Calif.

[73] Assignee: Hughes Electronics Corporation, El Segundo, Calif.

[21] Appl. No.: 09/209,078

[22] Filed: Dec. 10, 1998

[51] Int. Cl.[7] ..... H01Q 1/28; H01Q 3/46

[52] U.S. Cl. ..... 343/754; 343/909; 343/810

[58] Field of Search ..... 343/754, 753, 343/755, 909, 756, 794, 797, 810, 815, 816, 817, 818; H01Q 1/28, 3/46

[56] References Cited

U.S. PATENT DOCUMENTS 5,543,809 8/1996 Profera, Jr. ..... 343/756

5,864,322 1/1999 Pollon et al. ..... 343/754

5,959,594 8/1996 Wu et al. ..... 343/756

*Primary Examiner*—Hoanganh Le

*Attorney, Agent, or Firm*—Terje Gudmestad; M. W. Sales

[57] ABSTRACT

A reflectarray antenna for achieving increased dynamic phase range has a plurality of dipole elements positioned across the antenna surface. The elements include a single dipole element having a predetermined length that is approximately proportional to the dynamic phase range through which the first dipole element can reflect. The elements also include a coupled dipole element which comprises a longer dipole and a shorter dipole. The longer dipole and the shorter dipole are positioned on the reflectarray surface such that they are spaced a predetermined distance apart.

21 Claims, 4 Drawing Sheets

FULL DYNAMIC RANGE REFLECTARRAY ELEMENT

TECHNICAL FIELD

The present invention relates to reflectarray elements for satellite reflectarray antennas, and more particularly, to reflectarray elements for enhancing both the bandwidth and phase dynamic range of reflectarray antennas.

BACKGROUND ART

It is well-known in the art to use microwave phasing structures, commonly referred to as reflectarray elements or dipole elements, for electromagnetically emulating shaped reflective surfaces. The emulation occurs by controlling the reflection phases of the dipole elements that are positioned on the reflective surface. The reflection phases of the dipole elements are controlled by varying, among other things, the size, shape, length, and width of the reflectarray elements. These variations in the dipole elements modify the elemental reactance and thereby induce a reflection phase shift. Ideally, the larger the phase range of the reflectarray, the more signals it will be able to process through transmission and receipt. Currently, however, in order to increase the phase dynamic range for a reflectarray antenna, the bandwidth performance of the antenna will correspondingly decrease.

One known way of phasing dipole elements for linear polarization is to provide a plurality of parallel dipole elements across the surface of the reflectarray. The elements are typically arranged in a matrix with dipole elements extending across the reflectarray surface in rows and columns. In order to change the phase of a particular dipole element, the length or width of the dipole element is typically varied. Thus, the dipole elements in the matrix can vary in length and width from one dipole element to another. However, the length and width that the dipoles can be effectively varied is limited. For example, the length that a dipole element can be increased is limited due to interference with corresponding dipole elements in adjacent rows. Similarly, the width of a dipole element is limited because if it is made too thin, it can tear thus rendering it inoperable.

Accordingly, the configuration of these prior phasing dipole elements is disadvantageous in that they do not allow the phase dynamic range available from a reflectarray element to achieve a full 360 degrees without negatively impacting bandwidth performance. Attempts to increase the dynamic range of the prior art dipole elements have resulted in decreased bandwidth performance. Conversely, when the dipole elements are arranged in an attempt to provide better bandwidth performance, the phase dynamic range of the reflectarray elements decreases. Accordingly, there is no known way to provide both optimum dynamic phase range and optimum bandwidth performance.

SUMMARY OF THE INVENTION

It is an object of the present invention to provide mutual coupling between printed dipole elements to extend the phase dynamic range available from a reflectarray element. The present invention allows the dynamic phase range to be extended to a full 360 degrees.

In accordance with the objects of the present invention a reflectarray antenna with a plurality of reflectarray elements for achieving a full 360 degree phase dynamic range is provided. The reflectarray antenna consists of both single dipole elements, and elements consisting of coupled dipoles positioned across its surface. Each single dipole element has a predetermined length. The predetermined length of the single dipole element is roughly or approximately proportional to the reflected phase desired (relative to a zero-length dipole). The coupled dipole element comprises a longer dipole and a shorter dipole which are positioned on the reflectarray surface such that they are spaced a predetermined distance apart.

In a further aspect of the invention, the length of the single dipole element is preferably between 0.000 inches and 0.700 inches, for example, at a frequency of 11.8 GHz such that the phase dynamic range that the single dipole element reflects is about 270 degrees. The coupled dipole element enhances the dynamic range of the reflectarray by reflecting in the range from about 0 degrees to 90 degrees. With this configuration, the single dipole and coupled dipole elements provide phase reflection throughout a full 360 degrees dynamic range.

In still a further aspect of the invention, the longer dipole of the coupled dipole element preferably has a length between 0.400 inches and 0.600 inches, for example, at 11.8 GHz. The shorter dipole of the coupled dipole element preferably has a length between 0.200 inches and 0.400 inches, for example, at 11.8 GHz. Typically, a separation of about 0.000 to 0.300 inches, for example, at 11.8 GHz is required to obtain about 90° of phase dynamic range, thereby providing a full 360° phase dynamic range when used in conjunction with the single dipole element.

BEST MODES FOR CARRYING OUT THE INVENTION

Figure 1:
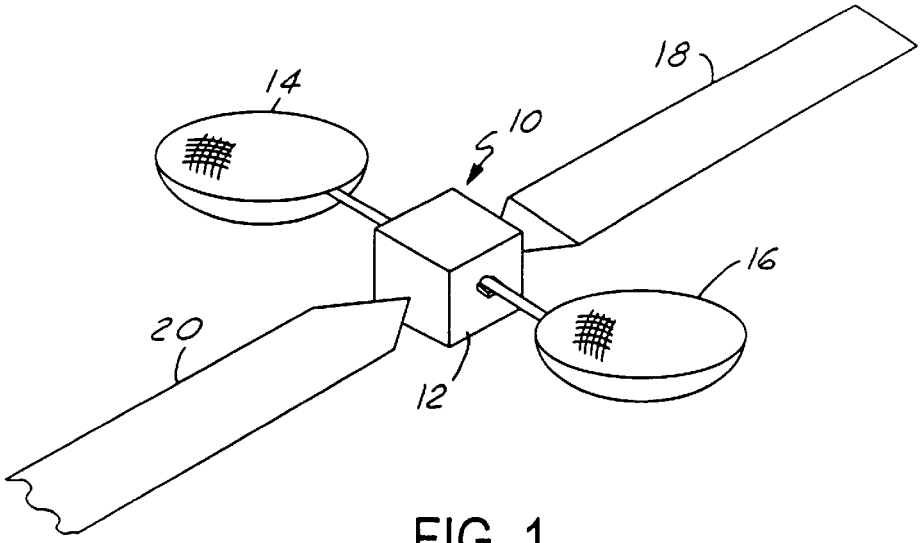
FIG. 1 is a perspective view of a satellite with a pair of reflectarray satellite antennas in accordance with the present invention.

The present invention is intended for use with any reflectarray application such as any high gain antenna application. Thus, the present invention may be used with any reflectarray antenna, including for example, on a conventional communications space satellite. A schematic representation of a satellite is illustrated in FIG. 1 with the satellite in a fully deployed position. In its fully deployed position, the satellite 10 has a housing 12 and a pair of reflectarray antennas 14, 16 that are connected to and extend outwardly from the housing 12. The housing 12 also has a pair of solar panels 18, 20 that extend outwardly from the housing 12.

Figure 2:
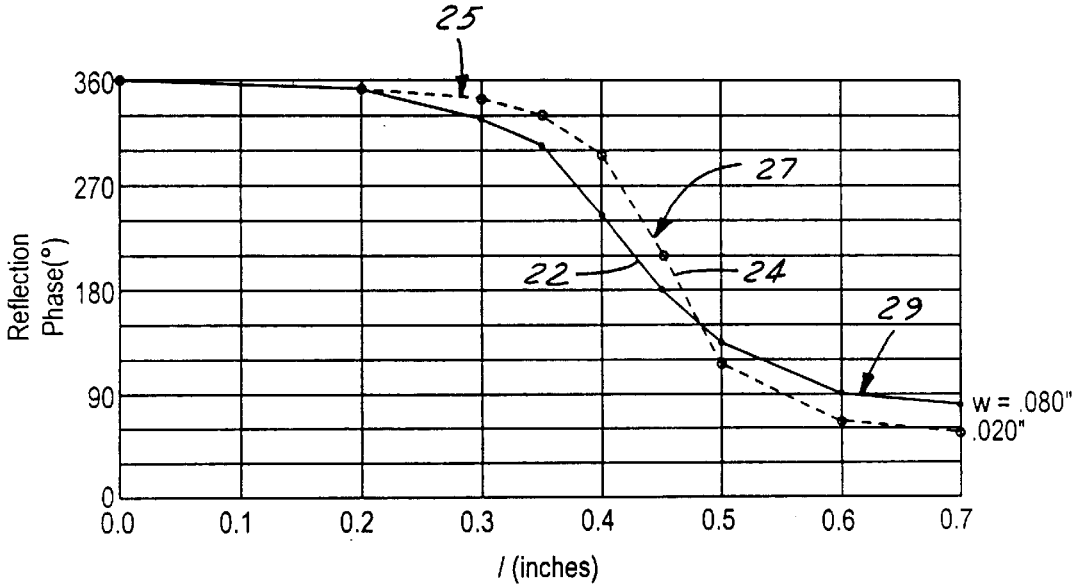
FIG. 2 is a diagram illustrating reflection phase plotted against dipole length for two dipoles of different widths in accordance with the present invention.

In designing reflectarray elements, the dynamic range and the bandwidth are two of the primary considerations. However, as the dynamic range is improved, the bandwidth quality is typically degraded. The inherent trade-off between bandwidth and dynamic range is illustrated in FIG. 2, which displays the phase of the electric field reflected from a dipole element as a function of the dipole length, for dipoles of two different widths. The first curve 22 represents a dipole element having a width of 0.080 inches. The second curve 24 represents a dipole element having a width of 0.020 inches. The frequency at which FIG. 2 is plotted is 11.8 GHz; the reflectarray substrate is air and one-quarter wavelength thick.

The two "S" curves shown in FIG. 2 provide information on both the bandwidth and dynamic range of the reflectarray element. The "S" curves have an upper region 25, a slope 27, and a lower region 29. The bandwidth and sensitivity to tolerances and temperature variations are closely related to the slope of the "S" curve for a given reflectarray element, with a gentler slope resulting in larger bandwidth and less sensitivity. The dynamic range available from the element is the peak-to-peak phase variation of the element with length, or in other words, the total y-axis excursion of the phase. It can be seen, for example, from the first curve 22 that when the reflectarray substrate is air and one-quarter wavelength thick, the dynamic range available from a 0.080" wide dipole is about 280 degrees. Further, as shown by the second curve 24, the dynamic range available from a 0.020" wide dipole is about 305 degrees. Thus, one must sacrifice bandwidth to obtain more dynamic range, or sacrifice dynamic range to obtain more bandwidth.

Typical reflectarray element bandwidths have proved insufficient for broadband applications. Therefore, attempts have been made to improve the bandwidth of reflectarray elements, at the cost of a decrease in dynamic range.

Figure 3:
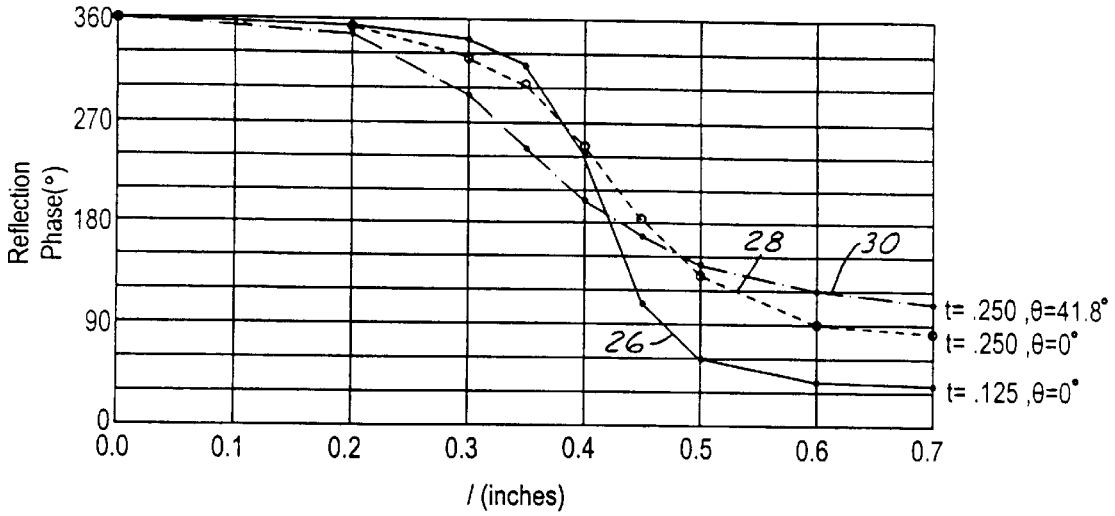
FIG. 3 is a diagram illustrating reflection phase plotted against dipole lengths for dipoles of varying substrate thickness, and illumination at large incidence angles in accordance with the present invention.

Two bandwidth enhancement methods are illustrated in FIG. 3. One method involves increasing the substrate thickness as represented by curve 28, while the other method involves illuminating the element at large incidence angles as represented by curve 30. Both methods result in an "S" curve having a gentler slope than the curve 26 with a thickness of 0.125 inches and illumination at small incidence angles. The "S" curves of FIG. 3 were plotted at a frequency of 11.8 GHz.

Bandwidth enhancement by increasing the element width, is demonstrated in FIG. 2. Bandwidth enhancement by increasing the substrate thickness, as represented by curve 28, and illumination at large incidence angles, as represented by curve 30, are demonstrated in FIG. 3. As shown, however, none of these methods have provided a full phase dynamic range of 360 degrees. Decreasing the substrate thickness as shown by curve 26 provides the largest phase range, but provides the steepest "S" curve with the most sensitivity to variables. Varying the incidence angle provides a gentler slope as shown in curve 30 with the least sensitivity to variables, but provides a much smaller dynamic range.

Figure 4:
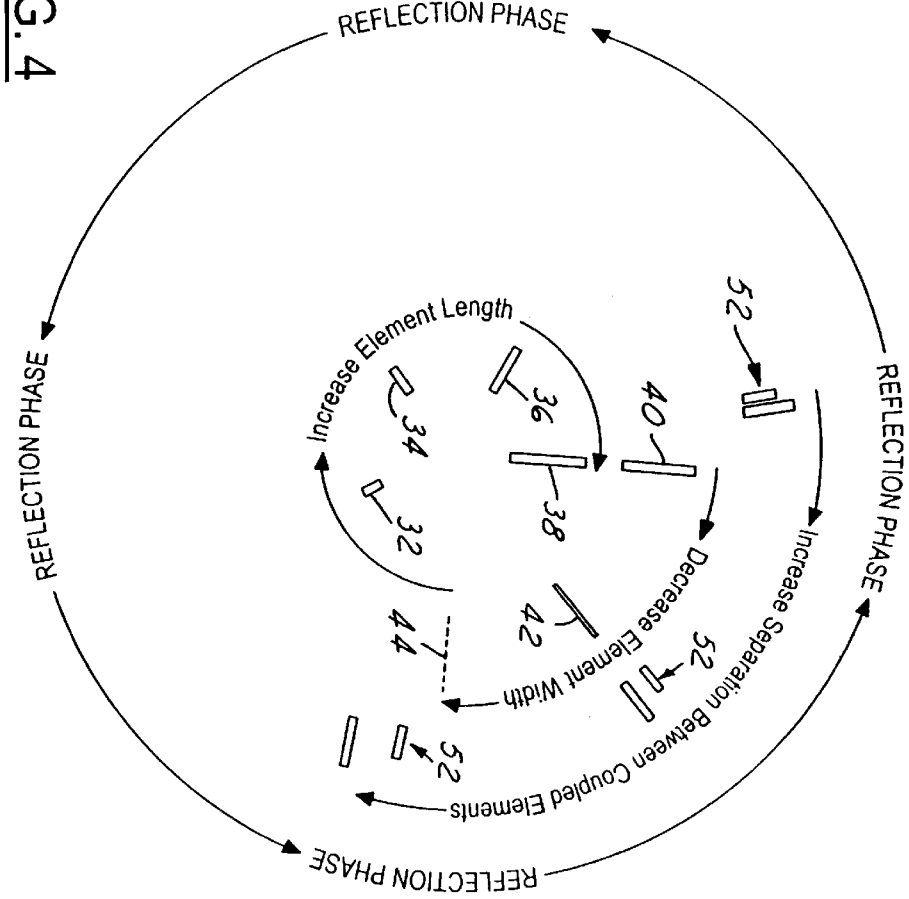
FIG. 4 is a schematic illustration of various reflectarray element dynamic range enhancement methods in accordance with the present invention.

Since bandwidth enhancement methods result in a decrease in the dynamic range available from an element, two methods for increasing dynamic range have been developed, and are illustrated in FIG. 4. As shown in FIG. 4, a plurality of dipole elements are shown in a plane in various configurations, as they would appear across the surface of a reflectarray antenna. The innermost dipoles 32, 34, 36, and 38 gradually increase in element length from 32 to 38. By arranging a plurality of dipoles in this manner, the typical reflection phase covered by the reflectarray is about 270 degrees. The amount the dipole length can be varied is limited. For example, if the length of the dipole were increased any further, the dipole would coincide, overlap into the dipoles 40, 42, 44, in the adjacent row of dipoles and interfere therewith. The length of the single dipole element can vary between 0 inches and 0.700 inches at a frequency of 11.8 GHz. It should be understood that as the center design frequency varies, the range of dipole lengths varies. For example, for a design frequency of 1 GHz, the length of the dipole may vary from about 0 inches to about 9 inches.

Figure 5:
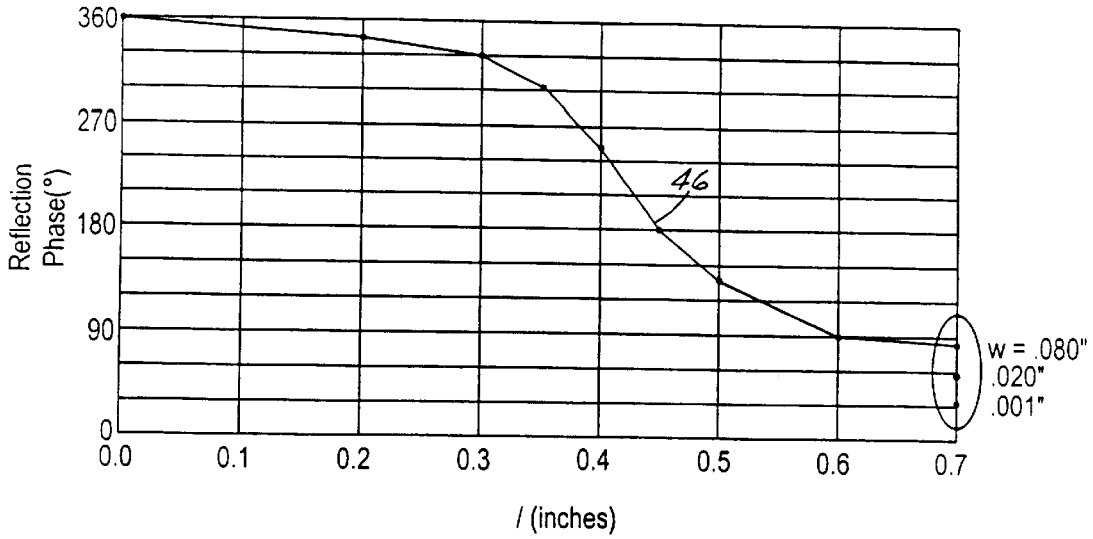
FIG. 5 is a diagram illustrating reflection phase plotted against dipole length for dipoles of different widths in accordance with the present invention.

The first method for increasing dynamic range is to employ the element width as an additional design parameter. This is represented by the dipoles 40, 42, 44 which are used in conjunction with the dipoles 32, 34, and 36, to allow the reflectarrays to fill out more of the dynamic phase range. This is shown by the curve 46 as illustrated in FIG. 5. This design concept relies upon the principle that the phase of the field reflected from an infinitesimally thin element approaches the phase of the field reflected when no element is present. This means that in theory a full 360 degree dynamic range can be obtained from a dipole by decreasing its width to zero. Implementation considerations, however, may limit the practical dynamic range to slightly less than 360 degrees.

As shown in FIG. 5, as illustrated by curve 46, a preferred dipole width of 0.080 inches will cover a dynamic range of a little more than 270 degrees, while decreasing the dipole width to about 0.001 inches results in a dynamic phase range of about 330 degrees. Although the dynamic range can be increased by reducing the width of any length dipole, a long dipole is preferred since the rate of change with width (and thus the sensitivity to tolerances and temperature variations) is minimum.

Figure 6:
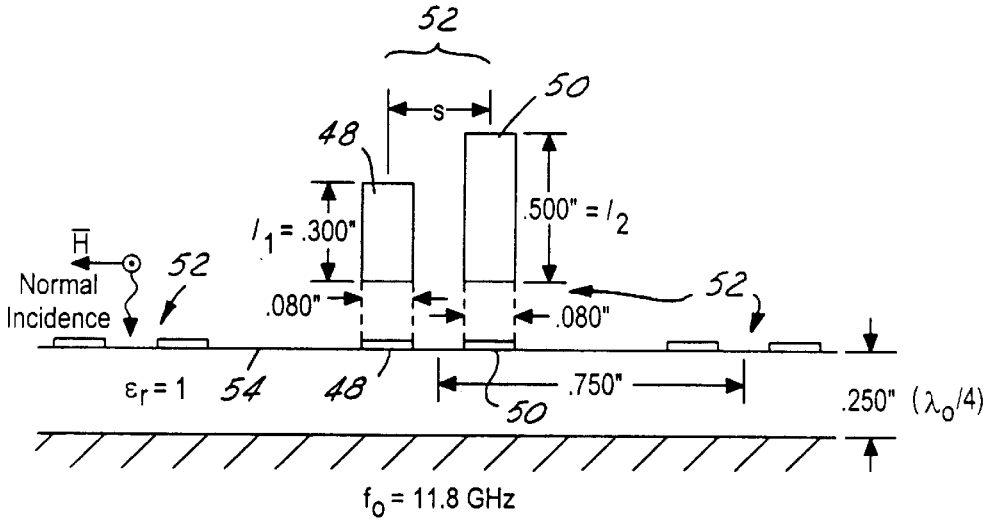
FIG. 6 is an illustration of a coupled dipole element in accordance with the present invention.
Figure 7:
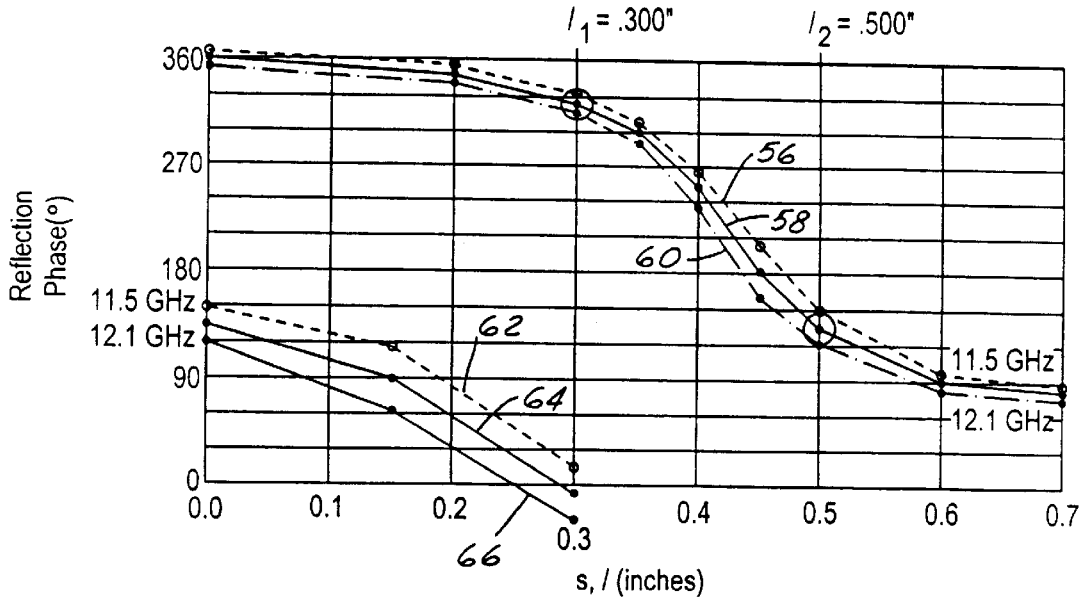
FIG. 7 is a diagram illustrating the reflection phase as a result of the utilization of coupled dipoles of unequal length in accordance with the present invention.

A second method for increasing the dynamic range is demonstrated in FIGS. 6 and 7. In this method, single dipoles of a predetermined length and coupled dipole elements are positioned across the surface 54 of a reflectarray antenna. The length of the single dipoles are scaled with the particular design frequency. In general, the dipole length scales with frequency on the order of one-half the free-space wavelength. The coupled dipoles consist of two dipoles of length $l_1$ and $l_2$ which bound the steep part of the "S" curve.

As shown in FIG. 6, the shorter dipole 48 and the longer dipole 50 are preferably utilized with a single dipole, such as 32, 34, 36, and 38. The shorter dipole 48 preferably has a length ($l_1$), for example, of 0.300 inches at a frequency of 11.8 GHz. However, it should be understood that the length of the shorter dipole can vary between 0.001 inches and a length corresponding to half-way down the "S" curve. The longer dipole 50 preferably has a length ($l_2$), for example, of about 0.500 inches at 11.8 GHz. The length of the longer dipole 50, however, may vary between halfway down the "S" curve and the maximum allowable length without touching dipoles in adjacent rows. The length of the single dipoles may also vary depending upon the particular reflectarray design frequency.

These dipoles 48 and 50 are then positioned close together and considered as a single element and are used in connection with single dipole element, such as 32 (see FIG. 4). By varying the dipole separation s, one can achieve the range of reflected field phases which cannot be obtained using a single dipole element of constant width. It should be understood that the coupled dipole element 52, comprised of the shorter and longer dipoles 48, 50 are just one element of a plurality of elements 52 which are positioned across the refletarray surface 54. Each of the plurality of elements 52 are spaced across the reflectarray surface 54 by preferably 0.750 inches (for example) for operation at 11.8 GHz. This will increase the usable surface area and not interfere with the performance of each reflectarray element 52. Both the dipole separation "s" and the spacing across the surface is dependent upon the design frequency.

A shown in FIG. 7, the "S" curves 56, 58, 60 are representative of a curve generated by a single dipole, such as 32, 34, 36, or 38. The single dipole 32, 34, 36, or 38 typically covers a dynamic range of about 270 degrees. The curves 62, 64, and 66 represent the dynamic range of the coupled dipole element 52 as the separation distance "s" between the shorter and the longer dipoles 48, 50 is varied. The separation distance between the shorter and longer dipoles 48 and 50 is preferably between the range of 0.000 inches and 0.300 inches. It should be understood that the separation may exceed 0.300 inches; although, a separation greater than 0.300 inches will provide a reflectarray phase dynamic range greater than 360 degrees at the frequencies shown in FIG. 7. However, the dipole separation also scales with the frequency. Thus, for a coupled dipole with a particular frequency design of about 1 GHz, the separation would vary between about 0 inches to about 4 inches.

Figure 8:
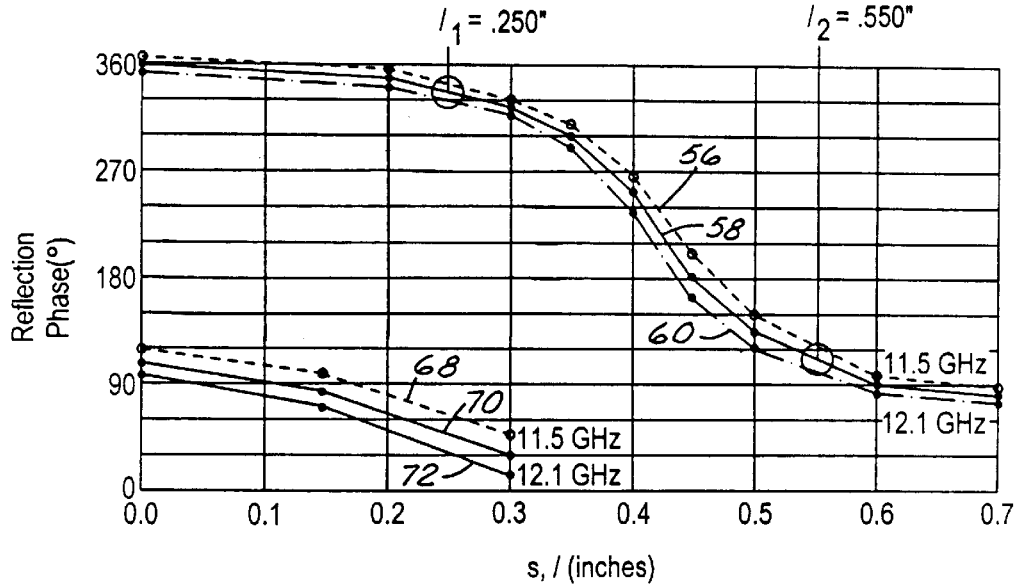
FIG. 8 is a diagram illustrating the reflection phase as a result of the utilization of coupled dipoles of unequal length in accordance with the present invention.

In FIG. 8, the dipole lengths have been chosen at two points slightly farther from the steep part of the typical "S" curve. In this embodiment, the first dipole has a length of 0.250 inches and the second dipole has a length of 0.550 inches. The curves produced by a coupled dipole element 52 having a shorter and longer dipole 48 and 50 of these lengths are represented by curves 68, 70, and 72. The result is that somewhat better bandwidth can be achieved at the cost of a smaller dynamic range.

Several techniques have been presented for improving the bandwidth and dynamic range of reflectarray elements in accordance with the preferred embodiments of the present invention. The bandwidth may be improved by increasing the substrate thickness or element width, or by illuminating the element at a large incidence angle. The dynamic range may be improved by decreasing the element width, or by exploiting the coupling between two dipoles of different length. In accordance with the present invention, a broadband element with full dynamic range is provided.

While the best modes for carrying out the invention have been described in detail, those familiar with the art to which this invention relates will recognize various alternative designs and embodiments for practicing the invention as defined by the following claims.

What is claimed is:

1. A reflectarray antenna, comprising:

at least one single dipole element having a predetermined length positioned on a reflectarray antenna surface, said length of said at least one single dipole element being approximately proportional to the desired reflected phase;

at least one coupled dipole element positioned on said reflectarray antenna surface having a longer dipole and a shorter dipole, said longer dipole being separated from said shorter dipole by a predetermined separation distance; and whereby said reflectarray antenna provides a phase response of a full 360 degrees.

2. A reflectarray antenna as recited in claim 1 wherein said dipole element have a predetermined frequency of operation.

3. A reflectarray antenna as recited in claim 2 wherein said length of said at least one single dipole element is between 0.000 inches and about three-quarters of a wavelength depending upon its design frequency.

4. A reflectarray antenna as recited in claim 3 wherein said length of said at least one single dipole element increases from 0.000 inches to about three-quarters of a wavelength depending upon the frequency of operation, and said dynamic phase range that said at least one single dipole element reflects typically is from about 80 degrees to about 360 degrees.

5. A reflectarray antenna as recited in claim 4 wherein said at least one coupled dipole element enhances the dynamic range such that said at least one single and said at least one coupled dipole elements provide phase reflection throughout a full 360 degrees.

6. A reflectarray antenna as recited in claim 5 wherein said longer dipole has a length for example between about 0.400 inches and about 0.600 inches at a frequency of operation of about 11.8 GHz.

7. A reflectarray antenna as recited in claim 6 wherein said shorter dipole has a length between about 0.200 inches and about 0.400 inches at a frequency of operation of about 11.8 GHz.

8. A reflectarray antenna as recited in claim 7 wherein said shorter dipole is separated from said longer dipole by a distance ranging between 0.000 inches and 0.300 inches at 11.8 GHz.

9. A reflectarray antenna as recited in claim 2 wherein said longer dipole of said at least one coupled dipole element has a length corresponding to the lower region of a typical bandwidth and dynamic range "S" curve, where the steep part of the curve transitions to a flatter curve.

10. A reflectarray antenna as recited in claim 9 wherein said shorter dipole of said at least one coupled dipole element has a length corresponding to the upper region of the "S" curve, where the flatter curve transitions to the steep part of the curve.

11. A reflectarray antenna as recited in claim 10 wherein said longer dipole is separated from said shorter dipole by a distance of between 0.000 inches and about one-half wavelength depending upon the frequency of operation.

12. A reflectarray antenna as recited in claim 2 further comprising a plurality of said single dipole elements and said coupled dipole elements disposed across said reflectarray antenna surface.

13. A space satellite for transmitting and receiving signals of various frequencies, comprising:

at least one reflectarray antenna associated with the space satellite to receive and reflect said signals, said at least one reflectarray antenna having an antenna surface;

a plurality of dipole elements positioned along said antenna surface, said dipole elements including:

a single dipole element having a predetermined length and width and having a dynamic phase range of less than 360 degrees;

a coupled dipole element, said coupled dipole element comprising a longer dipole and a shorter dipole which are separated from each other a predetermined distance, said coupled dipole element covering the dynamic phase range not covered by said single dipole element, whereby said single and coupled dipole elements provide a full dynamic phase range of 360 degrees.

14. The space satellite as recited in claim 13, wherein said single dipole element has a length of between about 0.000 and about 0.700 inches at a frequency of about 11.8 GHz.

15. The space satellite as recited in claim 13 wherein said longer dipole of said coupled dipole element has a length of about 0.550 inches at a frequency of about 11.8 GHz.

16. The space satellite as recited in claim 15 wherein said shorter dipole of said coupled dipole element has a length of about 0.250 inches at a frequency of about 11.8 GHz.

17. The space satellite as recited in claim 16 wherein said longer dipole is separated from said shorter dipole by a distance of between about 0.0 inches and 0.3 inches at a frequency of about 11.8 GHz.

18. The space satellite as recited in claim 13 wherein said longer dipole has a length between about 0.400 and about 0.600 inches at a frequency of about 11.8 GHz.

19. The space satellite as recited in claim 18 wherein said shorter dipole has a length between about 0.200 inches and about 0.400 inches at a frequency of about 11.8 GHz.

20. The space satellite as recited in claim 19 wherein said shorter dipole is separated from said longer dipole by a distance ranging between about 0.000 inches and about 0.300 inches at a frequency of about 11.8 GHz.

21. A method for providing a reflectarray antenna with enhanced dynamic range and enhanced broad bandwidth, comprising:

providing a single dipole element on a reflectarray antenna surface;

providing a coupled dipole element on said reflectarray antenna surface wherein said coupled dipole element has a longer dipole and a shorter dipole; and separating said longer dipole from said shorter dipole by a distance between about 0.000 and about one-half wavelength depending upon the frequency of operation of the reflectarray antenna.

* * * * *